US006612869B1

(12) United States Patent
Billman

(10) Patent No.: US 6,612,869 B1
(45) Date of Patent: Sep. 2, 2003

(54) HIGH DENSITY INTERCONNECTION SYSTEM

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/230,845

(22) Filed: Aug. 28, 2002

Related U.S. Application Data

(63) Continuation-in-part of application No. 10/162,724, filed on Jun. 4, 2002, and a continuation-in-part of application No. 10/152,936, filed on May 21, 2002.

(51) Int. Cl.[7] ..... H01R 13/648
(52) U.S. Cl. ..... 439/608
(58) Field of Search ..... 439/608, 609, 439/610, 541.5, 79, 66, 61, 65, 74, 76.1, 108, 680

(56) References Cited

U.S. PATENT DOCUMENTS 5,066,236 A * 11/1991 Broeksteeg ..... 439/79
5,980,321 A * 11/1999 Cohen et al. ..... 439/608
6,083,047 A * 7/2000 Paagman ..... 439/608

* cited by examiner

*Primary Examiner*—Jean Duverne
(74) *Attorney, Agent, or Firm*—Wei Te Chung

(57) ABSTRACT

A high density interconnection system (100) includes a daughter card header (1) and a backplane receptacle (2). The daughter card header comprises an insulative housing (10) and a number of signal terminals (14) and grounding members (15) received in the housing. The insulative housing is composed of a number of modularized housing portions (11, 12, 13) mechanically assembled with each other. The backplane receptacle has an insulative base (20), a cover (26) attached onto the insulative base, a plurality of circuit boards (27) arranged between the base and the cover, and a plurality of signal contacts (24) and grounding elements (25) received in the insulative base. The insulative base is composed of a plurality of modularized base sections (21, 22, 23) mechanically assembled with each other. The header and the receptacle each have a plurality of fastening means (117, 127, 127', 137, 204, 205) formed thereon to interconnect the plurality of housing portions and base sections.

14 Claims, 12 Drawing Sheets

HIGH DENSITY INTERCONNECTION SYSTEM

CROSS-REFERENCE TO RELATED APPLICATIONS

This patent application is a continuation-in-part (CIP) application of U.S. patent application Ser. No. 10/162,724, entitled "HIGH DENSITY ELECTRICAL CONNECTOR WITH LEAD-IN DEVICE", invented by Timothy Brain Billman and Iosif Korsunsky, filed on Jun. 4, 2002; and a CIP application of U.S. patent application Ser. No. 10/152,936, entitled "ELECTRICAL CONNECTOR", invented by Timothy Brain Billman, Eric Juntwait, Iosif Korsunsky and Chuck Pickles, filed on May 21, 2002, all assigned to the same assignee.

BACKGROUND OF THE INVENTION

1. Field of the Invention

The present invention generally relates to a high density interconnection system for interconnecting a daughter card to a backplane or a mother board, and particularly to a high density interconnection system having modularized housing parts which can be assembled together according to the desired number of pins and length of the connectors to simplify the assembling process and save the cost.

2. Description of Prior Arts

Many high-density, high-speed, high-performance interconnection systems for interconnecting a backplane or a mother board with daughter cards, are designed to be used in today's high-end computing and telecommunication equipments. Generally, a high-density interconnection system consists of a daughter card connector which is mountable on a daughter card and a backplane connector which is mountable on a backplane. Both the daughter card connector and the backplane connector have plural engagable signal contacts for transmitting high-speed data signals between the backplane and the daughter card.

Recently, a new product of above described backplane/daughtercard interconnect system, named XCELL™, is released by Litton's Winchester/Retconn Division which is now a member of Northrop Grumman's component technologies sector. The related patents of XCELL™ can be found in U.S. Pat. Nos. 6,179,663 and 6,206,729. As is introduced, XCELL™ consists of three different connector modules—signal, power, and guide. Both the backplane connector and the daughter card connector are manufactured individually, while the daughter card connector is mounted on an extruded aluminum board stiffener.

Moreover, U.S. Pat. No. 5,066,236 particularly discloses one type of backplane connector mountable on a mother board. The backplane connector includes a plurality of housing modules connected with each other to form a connector housing. The housing modules are substantially identical to each other and each housing module has a same number of contacts received therein. Similarly, U.S. Pat. Nos. 6,171,115 and 6,267,604 present the other type of backplane connector. This type of backplane connector has a housing which is a two-piece member including a front housing and an organizer. A plurality of wafers is assembled and organized between the front housing and the organizer, each wafer securing thereon a same number of contacts.

However, problems occurred in the above-mentioned connectors are addressed hereafter. Understandably, the number of signal terminals of a backplane connector, which is required to carry data signals, is different under different applications. Furthermore, for the different applications, the backplane connectors may require different lengths, but the above-mentioned connectors each are made with an integrated housing having a predetermined length which is not adjustable to alternate the length of the connector. Obviously, if different number of signal terminals or different length of the connector is desired, the connector should be redesigned. This increases the cost.

Hence, a high-density, high-speed connector having an improved housing is desired to overcome the disadvantages of the prior arts.

BRIEF SUMMARY OF THE INVENTION

Accordingly, an object of the present invention is to provide a high-density interconnection system which includes a daughter card header and a backplane receptacle, both the header and the receptacle having modularized housing parts which can be assembled together according to the desired number of pins and housing length to simplify the assembling process and save the possible cost.

In order to achieve the above-mentioned object, a high density interconnection system in accordance with the present invention includes a daughter card header mountable on a daughter card and a backplane receptacle mountable on a backplane. The daughter card header comprises an insulative housing and a number of signal terminals and grounding members received in the housing. The insulative housing is composed of a number of modularized housing portions assembled with each other. The daughter card connector has a number of first fastening means to interconnect the housing portions. Each first fastening means comprises a first member and a second member. The first member is formed on one of the housing portions and the second member is formed on a neighboring housing portion. The first member defines a cutout on a top side thereof, a pair of opposed indents in a lower side thereof and a recess extending between the cutout and the pair of indents. The second member comprises a main body with a lock formed on an upper end thereof and a pair of embossments formed on opposite sides of a lower end of the main body. The main body is received in the recess with the pair of embossments being retained in the pair of indents and the lock being retained in the cutout and abutting thereagainst. Therefore, the adjacent two housing portions are mechanically connected together.

The backplane receptacle has an insulative base, a cover attached onto the insulative base, a plurality of circuit boards arranged between the base and the cover, and a plurality of signal contacts and grounding elements received in the insulative base. The insulative base is composed of a plurality of modularized base sections assembled with each other. The backplane receptacle has a plurality of second fastening means to interconnect the plurality of base sections. Each second fastening means comprises a first device and a second device. The first device is formed on one of the base sections and the second device is formed on a neighboring base section. The first device defines a recess and a pair of opposed indents in a lower side thereof. The second device comprises a main body with a lock formed on an upper end thereof and a pair of embossments formed on opposite sides of a lower end of said main body. The main body is received in the recess with the pair of embossments being retained in the pair of indents and the lock abutting against a top edge of the first device. Therefore, the adjacent two base sections are mechanically connected.

Each of the modularized housing portions has a similar structure while receives a different number of signal terminals therein and has a different length. The housing portions can be combined to form a housing having a predetermined length and a predetermined number of signal terminals according to the requirements in practical application. The modularized base sections of the backplane receptacle have a similar structure as the modularized housing portions of the daughter card header.

Other objects, advantages and novel features of the invention will become more apparent from the following detailed description of the present embodiment when taken in conjunction with the accompanying drawings.

DETAILED DESCRIPTION OF THE INVENTION

Figure 1:
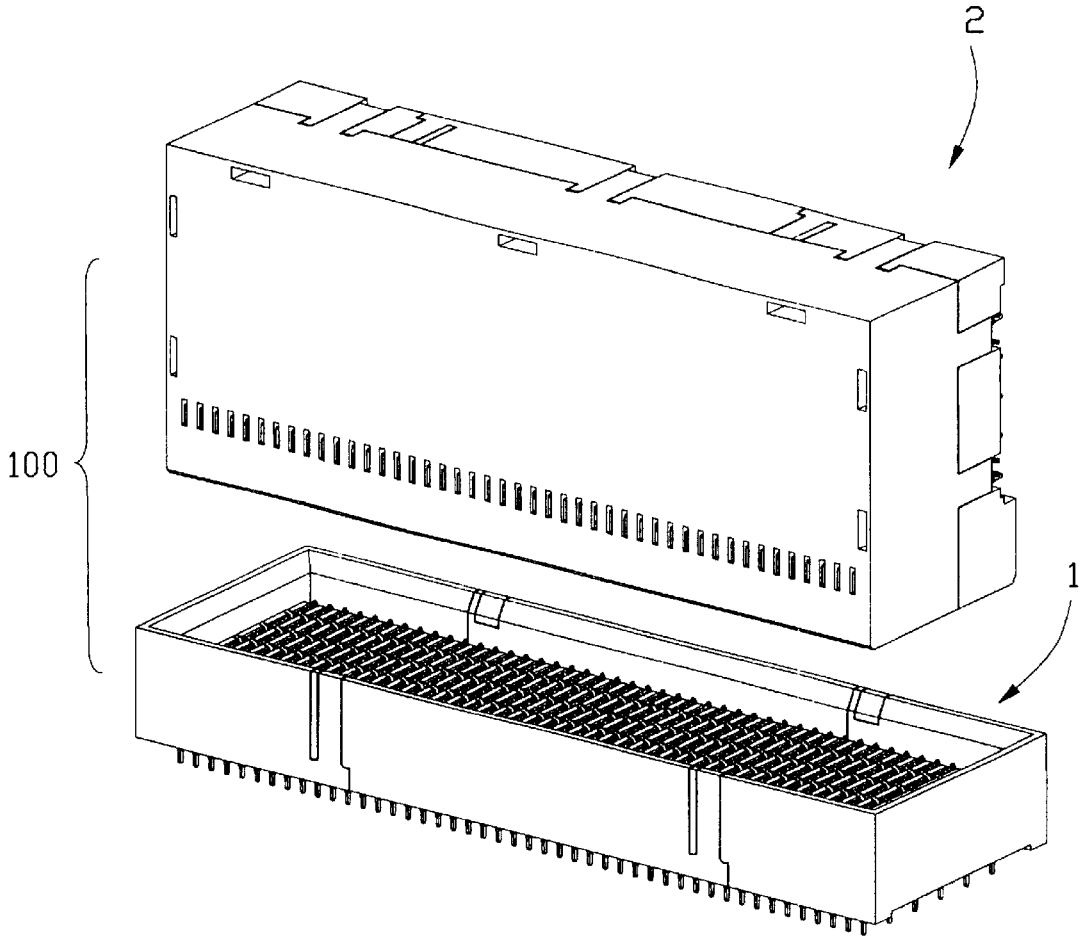
FIG. 1 is an unmated, perspective view of a high density interconnection system in accordance with the present invention.

Reference will now be made to the drawing figures to describe the present invention in detail.

Figure 2:
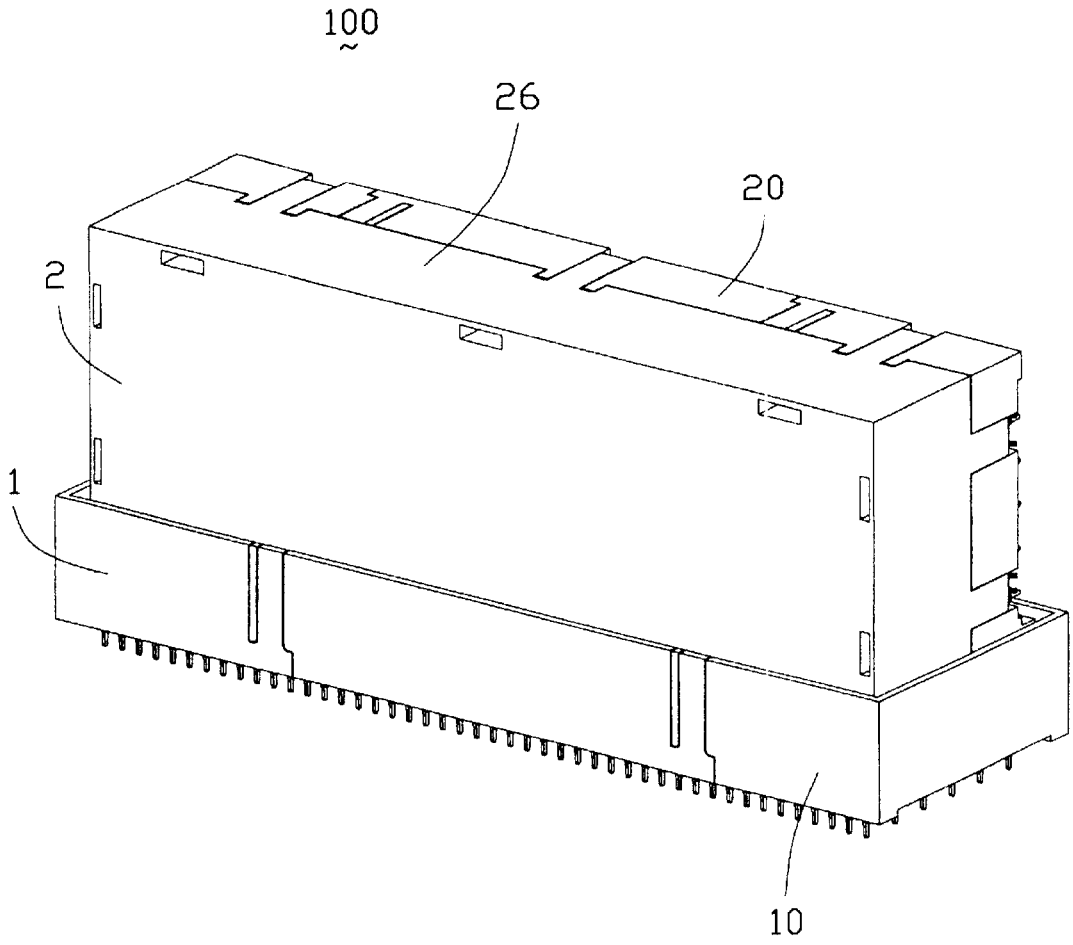
FIG. 2 is an assembled view of FIG. 1.

With reference to FIGS. 1 and 2, an exemplary, high-density interconnection system 100 structured in accordance with the present invention is adopted for interconnecting a mother board and a daughter card (neither is shown). The high-density interconnection system 100 comprises a daughter card header 1 mounted to the daughter card and a complementary backplane receptacle 2 mounted to the mother board.

Together referring to FIGS. 3 and 3A–3D, the daughter card header 1 includes a housing 10, a plurality of signal terminals 14 (FIG. 3B) and grounding members 15 attached alternately to the housing 10. In the preferred embodiment, the housing 10 of the daughter card header 1 consists of three different housing parts mechanically assembled with each other.

Figure 3:
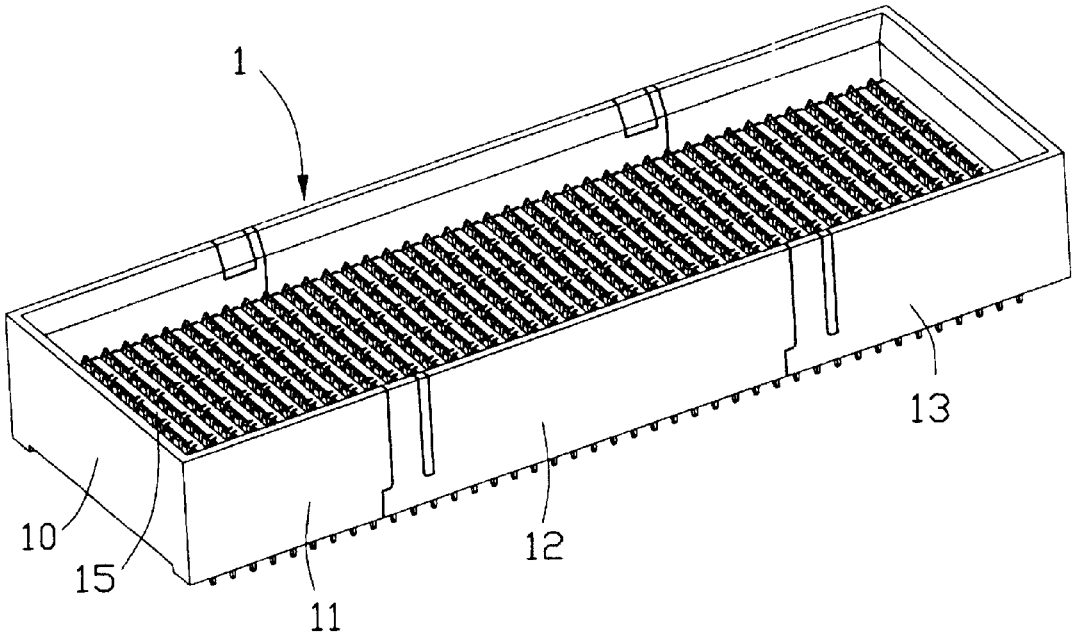
FIG. 3 is a perspective view of a header of the high density interconnection system of FIG. 1.
Figure 3A:
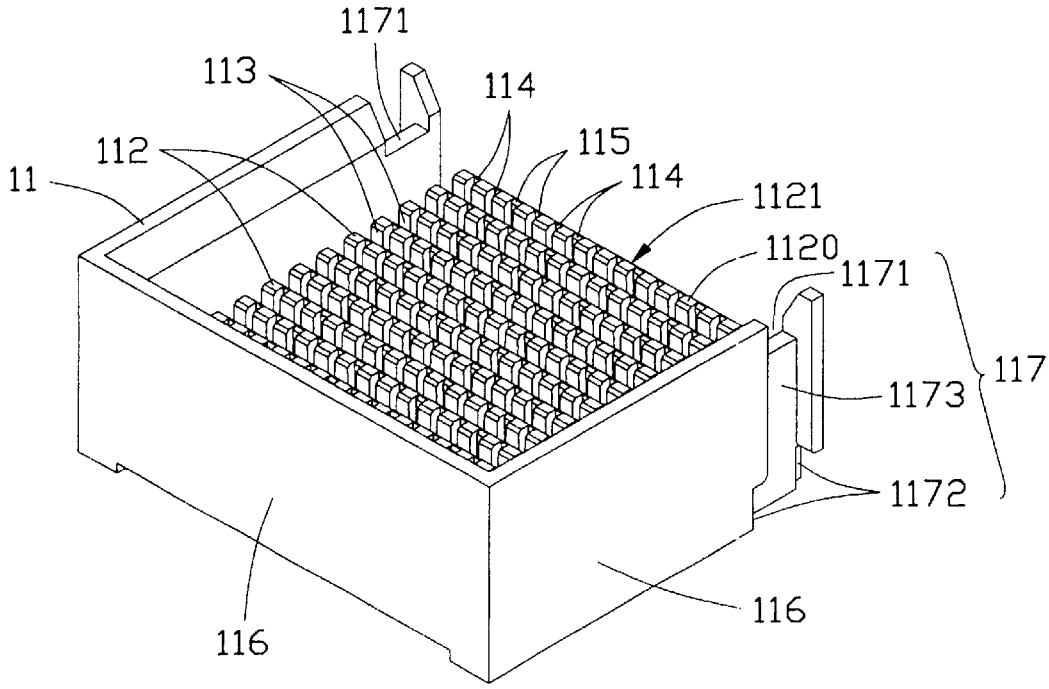
FIG. 3A is a perspective view of a left end housing portion of the header in FIG. 3.
Figure 3B:
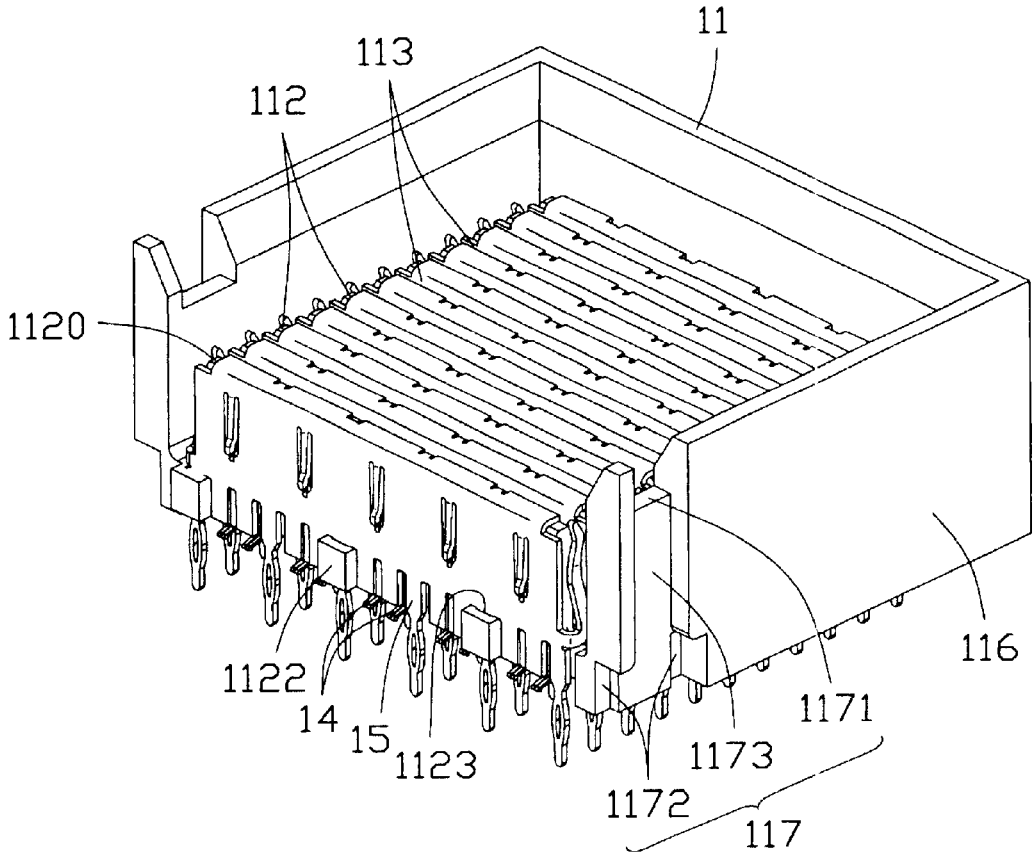
FIG. 3B is another perspective view of the left end housing portion with a plurality of signal terminals and grounding members being attached therein.

As shown in FIGS. 3A and 3B, a left end housing portion 11 of the header housing 10 is located in a leftmost end of the header housing 10. The left end housing portion 11 has a number of partition walls 112 formed integrally and extending parallel to each other with a plurality of slots 113 being respectively defined between every two adjacent partition walls 112. The signal terminals 14 and the grounding members 15 are respectively secured on opposite sides of each partition wall 112. Each partition wall 112 defines on one side thereof with a plurality of pairs of terminal receiving channels 114, and a plurality of grooves 115 recessed respectively between every two pairs of channels 114. The plurality of pairs of terminal receiving channels 114 extend perpendicularly through the partition wall 112 for receiving therein corresponding signal terminals 14 while the grooves 115 are for receiving therein corresponding parts of the grounding member 15. For the details of the configurations of the grounding members 15 and the signal terminals 14, one can refer to one of the mother patent applications from which this patent application claims priority.

Continuing referring to FIGS. 3A and 3B, the left end housing portion 11 further has three side walls 116 surrounding the number of partition walls 112 and leaves a rightmost partition wall 1120 exposed to mechanically engage with a leftmost side of a middle housing portion 12 (FIG. 3C) of the header housing 10. Compared with the above-described partition walls 112, the rightmost partition wall 1120 further forms a first engaging face 1121 on an outer surface thereof opposite to the plurality of channels and grooves 114, 115. There are three first blocks 1122 dispersedly formed on the first engaging face 1121, each first block 1122 defining a hole 1123 therethrough. Moreover, two of the side walls 116, which stand at opposite ends of the partition walls 112 each define a female engagable device 117 adjacent to the rightmost partition wall 1120. Each of the female engagable devices 117 has a cutout 1171 defined in a top edge of the side wall 116, a pair of indents 1172 depressed oppositely in a lower side, and a recess 1173 extending across the side wall 116 straightly.

Figure 3C:
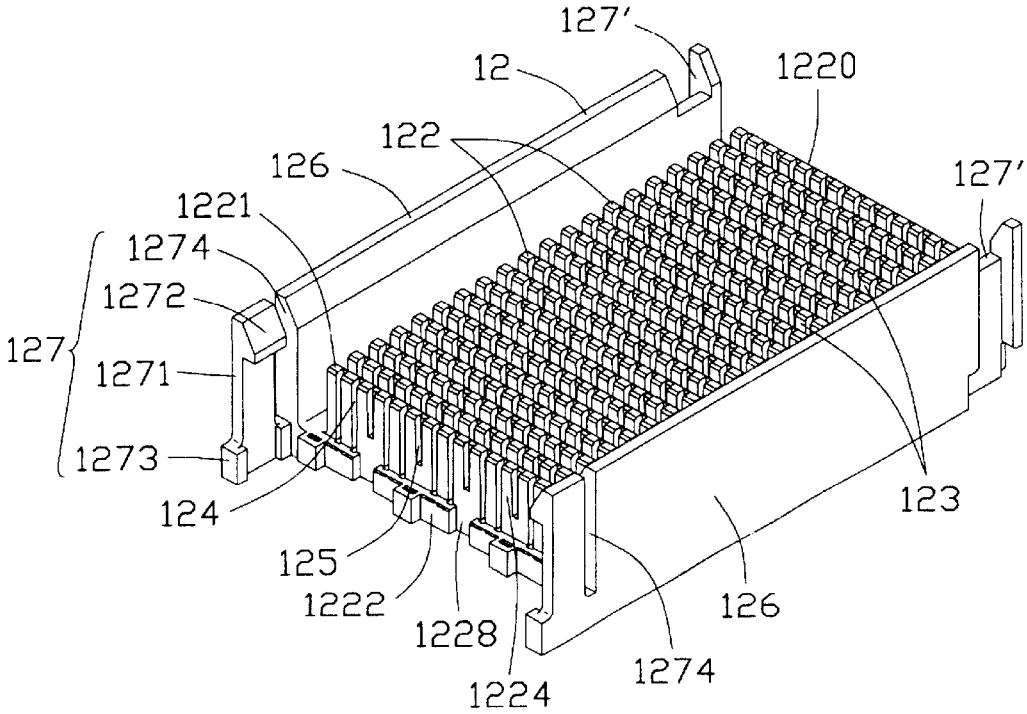
FIG. 3C is a perspective view of a middle housing portion of the header.

Turning to FIG. 3C, the middle housing portion 12 of the header housing 10 is shown in detail. The middle housing portion 12 includes two parallel side walls 126 and a number of partition walls 122 interposed between the two side walls 126. There are a plurality of elongated slots 123 respectively defined between every two neighboring partition walls 122. Similar to the structure of the partition wall 112 of the left end housing portion 11, the partition wall 122 of the middle housing portion 12 also defines a plurality of terminal receiving channels 124 and grooves 125 in one side thereof.

Specifically, the middle housing portion 12 of the header housing 10 includes a leftmost and a rightmost partition wall 1221, 1220 respectively formed on opposite sides thereof. The leftmost partition wall 1221 of the middle housing portion 12 confronts the rightmost partition wall 1120 of the left end housing portion 11 and is configured to engage thereto. The leftmost partition wall 1221 has a second engaging face 1224 on an outer surface thereof for coupling with the first engaging face 1121 of the left end housing portion 11. The leftmost partition wall 1221 further forms three second blocks 1222 on the second engaging face 1224. There are three notches 1228 in the second engaging face 1224 of the leftmost partition wall 122. Each notch 1228 is defined between adjacent second blocks 1222 for receiving therein a portion of the first block 1122 of the left end housing 11. The rightmost partition wall 1220 of the middle housing portion 12 has an identical configuration as the rightmost partition wall 1120 of the left end housing portion 1120; thus, the detail of the right partition wall 1220 is omitted herein.

Furthermore, referring to FIG. 3C, the middle housing portion 12 has a pair of male engagable devices 127 formed in the vicinity of the two side walls 126, respectively, and adjacent to the leftmost partition wall 1221. Each of the male engagable devices 127 includes a straightly extended body 1271 with a hook-like lock 1272 formed on an upper side of the straightly extended body 1271 and a pair of embossments 1273 oppositely protruding from a lower side of the body 1271. A deep slit 1274 is defined between the straightly extended body 1271 and a corresponding side wall 126. The middle housing portion 12 also has a pair of female engagable devices 127', which is located oppositely beside the rightmost partition wall 1220 and is structured identically to the female engagable devices 117 of the left end housing portion 11.

During assembling the middle housing portion 12 with the left end housing portion 11, the female engagable devices 117 engage with the male engagable devices 127 to securely connect the housing portions 11, 12 together. The straightly extended body 1271 of the male engagable device 127 is received in the recess 1173 of the female engagable device 117, with which the hook-like lock 1272 of the male engagable device 127 is caught within the cutout 1171 of the female engagable device 117 and the pair of embossments 1273 are engaged within the pair of indents 1172. Simultaneously, the first blocks 1122 of the left end housing portion 11 are respectively received in the notches 1228 of the middle housing portion 12. Thus, the left end housing portion 11 and the middle housing portion 12 are firmly connected together.

Figure 3D:
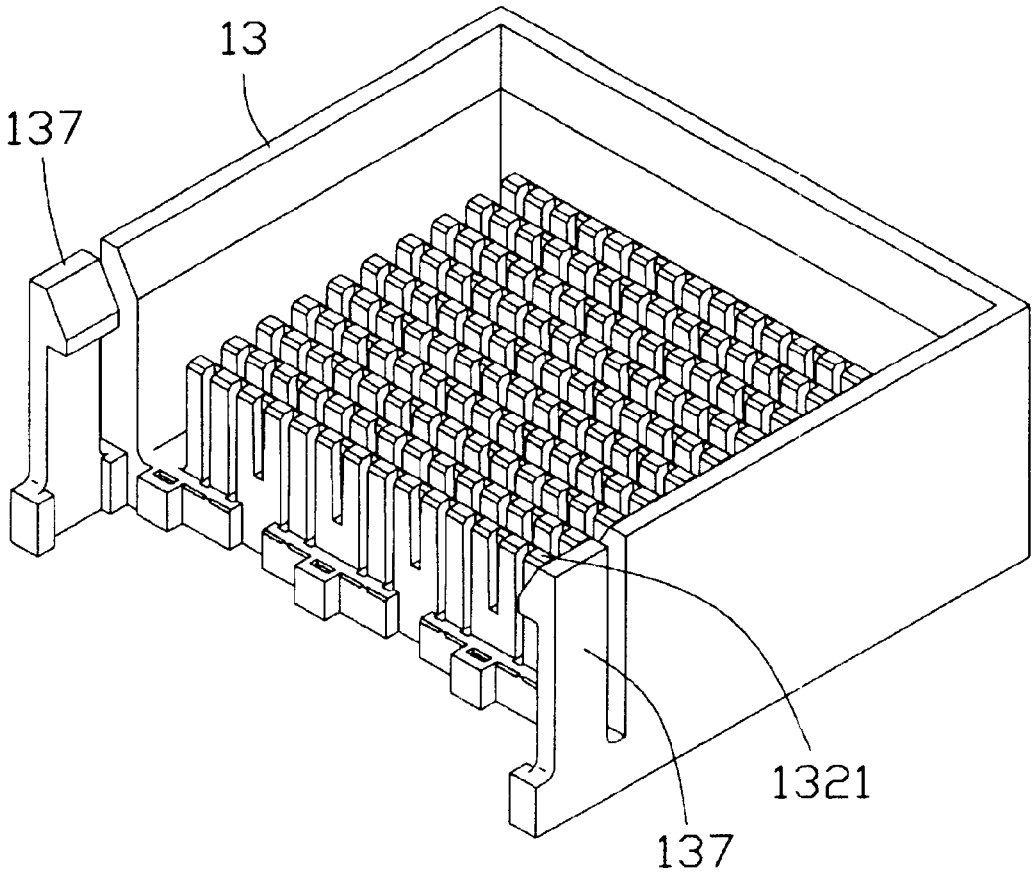
FIG. 3D is a perspective view of a right end housing portion of the header.
Figure 3E:
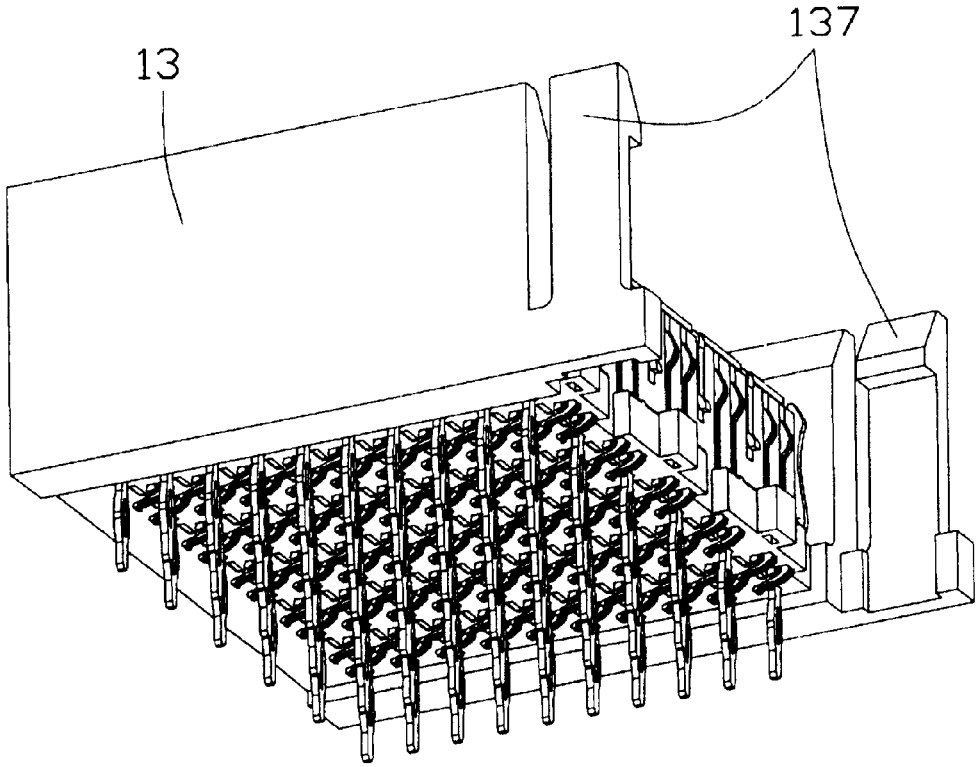
FIG. 3E is another perspective view of the right end housing portion with a plurality of signal contacts and grounding members being attached therein.

Referring to FIGS. 3D and 3E, a right end housing portion 13 of the header housing 10 has a similar configuration with the left end housing portion 11, while the right end housing portion 13 leaves a leftmost partition wall 1321 confronting the rightmost partition wall 1220 of the middle housing portion 12 and cooperating thereto, and has a pair of male engagable devices 137 for mating with the pair of female engagable devices 127'. Consequently, the assembly between the middle housing portion 12 and the right housing portion 13 is the same as that between the middle housing portion 12 and the left end housing portion 11. Obviously, the three housing portions 11, 12 and 13 are mechanically and securely connected with each other to form the header housing 10 via the engagements between the female engagable devices 117, 127' and the male engagable devices 127, 137.

Figure 4:
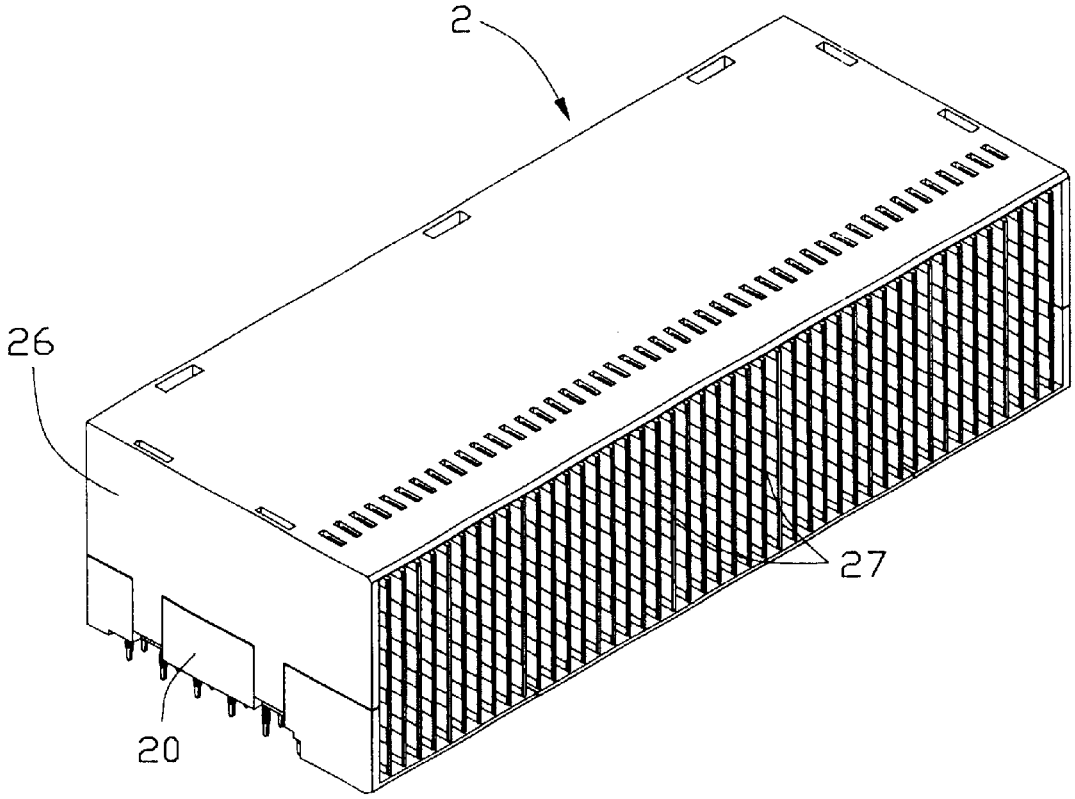
FIG. 4 is a perspective view of a receptacle of the high density interconnection system of FIG. 1.
Figure 5:
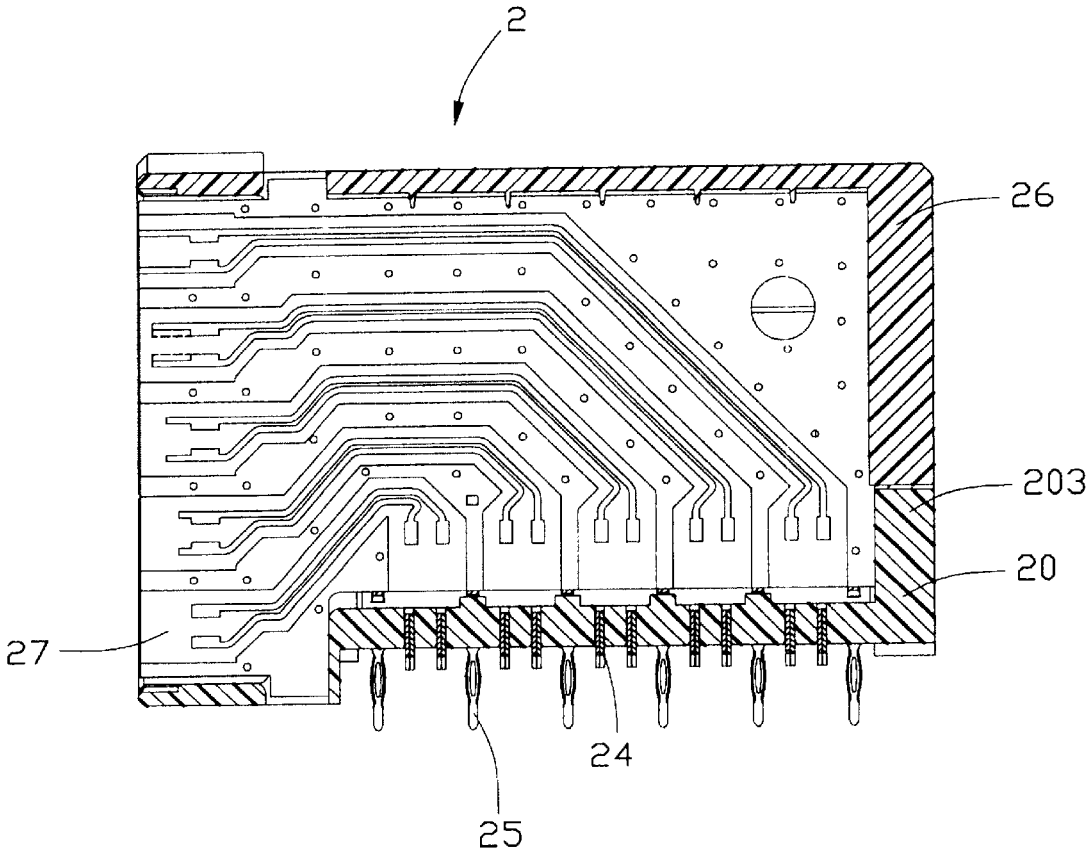
FIG. 5 is an enlarged, cross-sectional view of the receptacle of FIG. 4.

Together referring to FIGS. 4 and 5, the backplane receptacle 2 of the present invention comprises an insulative base 20, a cover 26, a plurality of circuit boards 27 parallelly assembled between the insulative base 20 and the cover 26, a plurality of signal contacts 24 and grounding members 25 assembled in the insulative base 20.

Figure 6:
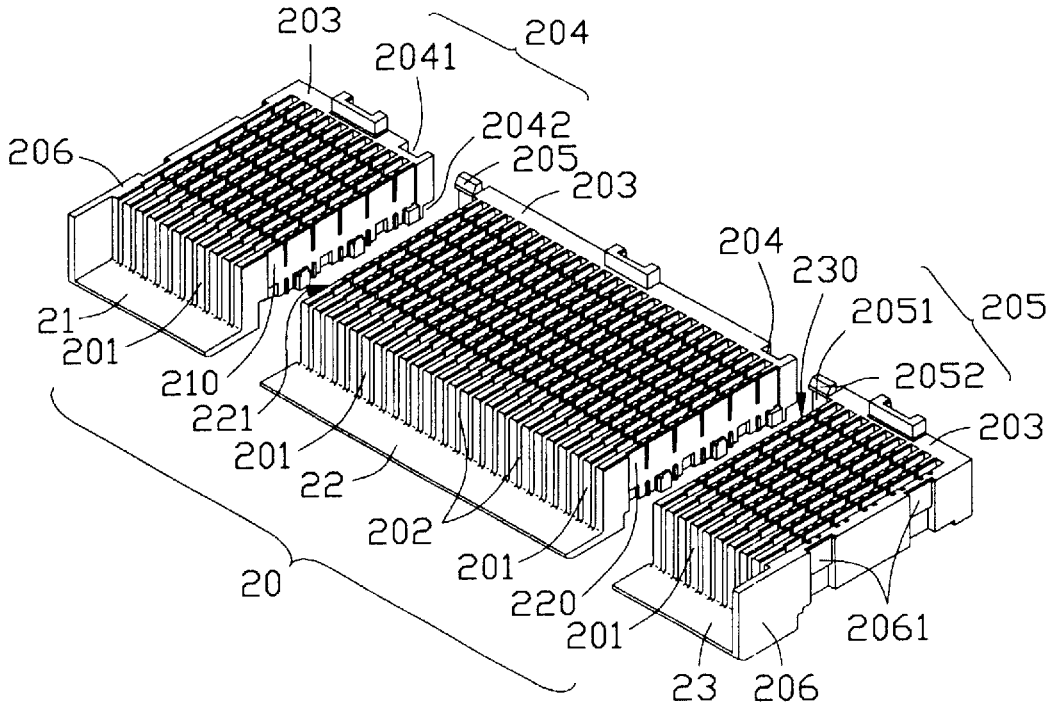
FIG. 6 is an exploded, perspective view of an insulative base of the receptacle.

Particularly referring to FIG. 6, the insulative base 20 of the backplane receptacle 2 is composed of three separate parts—a left end section 21, a middle section 22, and a right end section 23. Each section includes a plurality of identical, inner walls 201 extending parallel to each other and defining a plurality of slots 202 therebetween for receiving corresponding circuit boards 27 therein. Each of the inner walls 201 defines a number of channels and grooves (not labeled) in one side thereof for receiving corresponding signal contacts 24 and corresponding parts of the grounding member 25. For the details of the configurations of the grounding members 25 and the signal terminals 24, one can refer to the one of mother patent applications from which this patent claims priority.

As shown in FIG. 6, each section also has a rear wall 203 extending traverse and interconnecting rear ends of the plurality of inner walls 201. Especially, the left end section 21 has a female mating device 204 defined on its rear wall 203 near to the middle section 22; the middle section 22 has a male mating device 205 and a female mating device 204 oppositely defined on its rear wall 203; and the right end section 23 has a male mating device 205 defined on its rear wall 203 near to the middle section 22. It is easy to see that the three sections 21, 22, and 23 are mechanically and securely connected with each other to form the insulative base 20 of the receptacle 2 via the engagements between the female mating devices 204 and the male mating devices 205. In detail, the female mating device 204 has a recess 2041 extending across the rear wall 203 and a pair of indents 2042 oppositely defined in a lower side of the rear wall 203. While, the male mating device 205 comprises an elongated, main body 2051 with a holding lock 2052 formed on a top edge thereof, and a pair of embossments (not shown) oppositely formed on a lower side of the main body 2051.

Moreover, the left end section 21 further defines a first mating face 210 on a rightmost side thereof. The right end section 23 further defines a second mating face 230 on a leftmost side thereof. The middle section 22 further defines a second mating surface 221 confronting the first mating face 210 of the left end section 21 and an opposite, first mating surface 220 confronting the second mating face 230 of the right end section 23. Specifically, the first mating face 210 and the first mating surface 220 are identical and the second mating face 230 and the second mating surface 221 are identical. On each of the first mating face 210 and the first mating surface 220, there are three first blocks 207 formed dispersedly. On each of the second mating face 230 and the second mating surface 221, there are three second blocks 208 formed dispersedly and three notches 209 defined between the second blocks 208. The first blocks 207 are configured to be received in corresponding notches 209.

During assembly, the elongated, main body 2051 of the male mating device 205 is received in the recess 2041 of the female mating device 204 with the holding lock 2052 abutting against a top face of the rear wall 203 and the pair of embossments being retained in the pair of indents 2042. The first mating face 210 and the first mating surface 220 engage with the second mating surface 221 and the second mating face 230, respectively. Thus, the sections 21, 22, 23 are mechanically connected together.

Referring to FIG. 6, the insulative base 20 of the backplane receptacle 2 also has a pair of opposed, side walls 206 respectively formed on the left end section 21 and the right end section 23. There are two separated grooves 2061 recessed in each of the opposed side walls 206.

Figure 7:
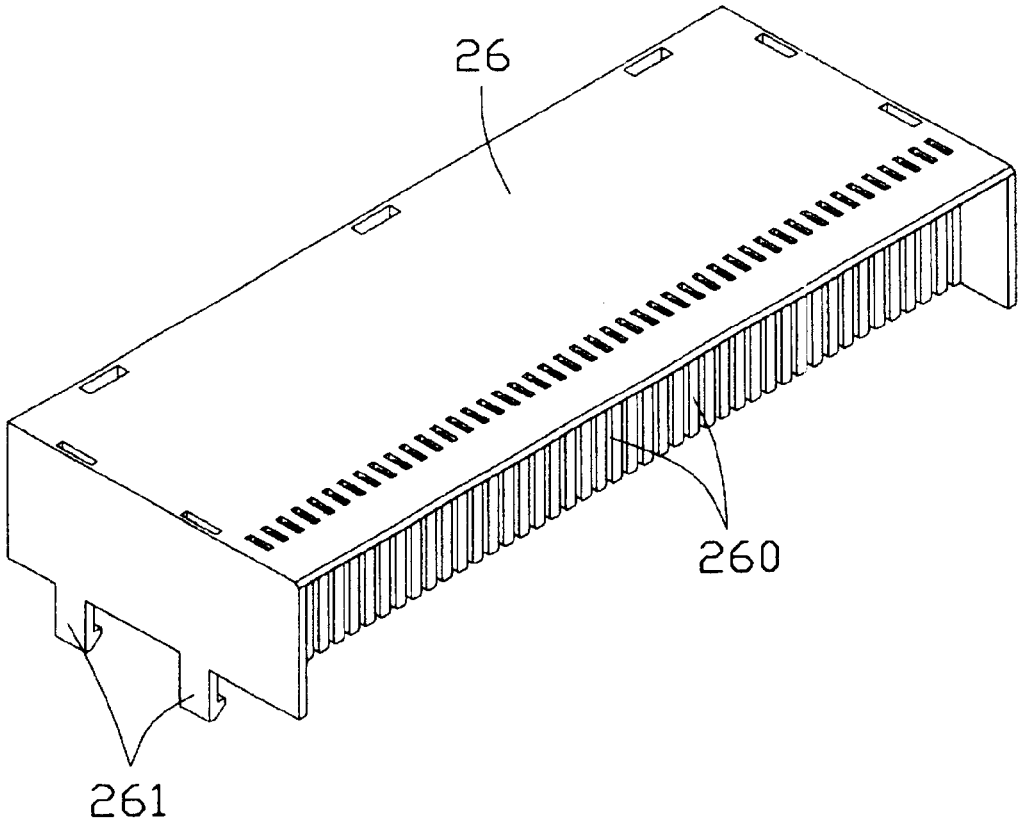
FIG. 7 is a perspective view of a cover of the receptacle.

With reference to FIG. 7, the cover 26 of the backplane receptacle 2, which is made of insulative material, defines a plurality of elongated recesses 260 aligning with corresponding slots 202 of the insulative base 20 for receiving the plurality of circuit boards 27 therein. The cover 26 has two pairs of claws 261 formed respectively on two opposed sides thereof for engaging with corresponding grooves 2061 of the insulative base 20 to firmly secure the cover 26 and the base 20 together to thereby allow the circuit boards 27 to be precisely located in their respective positions. For the details of the configurations of the cover 26 and the circuit boards 27, one can refer to a co-pending application of the present application, i.e., U.S. patent application Ser. No. 10/152936, entitled "ELECTRICAL CONNECTOR", invented by Timothy Brain Billman, Eric Juntwait, Iosif Korsunsky and Chuck Pickles, filed on May 21, 2002, and assigned to the same assignee of the present application, the disclosure of which is wholly incorporated herein by reference.

In assembly, the three separate sections 21, 22, and 23 of the backplane receptacle 2, with which the grounding members 25 and the signal contacts 24 are pre-assembled thereon, are firstly jointed to form the insulative base 20. Then, the plurality of circuit boards 27 are received in corresponding slots 202 of the base 20 and electrically connect with corresponding grounding members 25 and signal contacts 24. Finally, the cover 26 is attached to the base 20 and cooperates with the base 20 to thereby firmly retain the circuit boards 27 therebetween. When the backplane receptacle 2 mates with the daughter card header 1, data signals can be transmitted from the signal contacts 24 of the backplane receptacle 2 to the signal terminals 14 of the daughter card header 1 through corresponding circuit boards 27.

It can be seen from the drawings and the above description that the housing 10 of the header 1 and the base 20 of the receptacle 2 each include a left end portion 11(21), a middle portion 12(22) and a right end portion 13(23), which can be readily connected to or disconnected from each other. Thus, the length of the header 1 or receptacle 2 can be adjusted by combining any of the sections 11(21), 12(22) and 13(23) together. For example, the header 1 and the receptacle 2 only have the left end portions 11, 21 mating with each other; in this situation, the interconnecting system has the shortest length. On the other hand, the header 1 and the receptacle 2 can have a combination of the left and middle end portions 11, 12; 21, 22, whereby the interconnecting system can have a longer length to meet a different requirement. Advantageously, the housing parts are modularized to thereby be assembled according to the desired number of terminals and length of the interconnecting system to simplify the assembling process and save the cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high density interconnection system, comprising:

a first electrical connector comprising an insulative housing and a number of signal terminals and grounding members received in said housing, said insulative housing being composed of a number of modularized housing parts separably assembled together, said first electrical connector having first fastening means for interconnecting said number of housing parts together; and a second electrical connector having an insulative base, a cover attached onto said insulative base, a plurality of circuit boards arranged between said base and cover, and a plurality of signal contacts and grounding elements received in said insulative base, said insulative base being composed of a plurality of modularized base sections separably assembled together, said second electrical connector having second fastening means for interconnecting said plurality of base sections together;

wherein when said first electrical connector is mated with said second electrical connector, an electrical trace is established between the signal terminals of said first electrical connector and the signal contacts of said second electrical connector via the circuit boards;

wherein said first fastening means comprises a first member and a second member, said first member being formed on one of said housing parts and said second member being formed on a neighboring housing part;

wherein said first member of said first fastening means defines a cutout in a top side thereof, a pair of opposed indents in a lower side thereof and a recess extending between said cutout and said pair of indents, and said second member of said first fastening means comprises a main body with a lock formed on an upper end thereof and a pair of embossments formed on opposite sides of a lower end of said main body, wherein said main body is received in said recess with said pair of embossments being retained in said pair of indents and said lock being retained in said cutout and abutting thereagainst.

2. The high density interconnection system as described in claim 1, wherein each of said modularized housing parts comprises a number of parallel extended partition walls with a number of first slots being defined therebetween.

3. The high density interconnection system as described in claim 2, wherein at least one of said modularized housing parts has a first engaging face and a second engaging face oppositely formed thereon and respectively confronting with adjacent housing parts for engaging therewith.

4. The high density interconnection system as described in claim 3, wherein said modularized housing parts have two outermost housing parts, one of said two outermost housing parts has a first engaging face and the other one of said two outermost housing parts has a second engaging face.

5. The high density interconnection system as described in claim 4, wherein said first engaging faces each have at least one block formed thereon and said second engaging faces each have at least one notch defined therein, said at least one blocks engaging in said at least one notches to securely connecting the housing parts together.

6. The high density interconnection system as described in claim 4, wherein said first engaging face of the one of the two outermost housing parts has at least one block formed thereon and said second engaging face of the other one of said outermost housing parts has at least one notch defined therein.

7. The high density interconnection system as described in claim 1, wherein each of said modularized base sections comprises a number of parallel extended inner walls with a number of second slots defined therebetween for receiving corresponding circuit boards therein.

8. The high density interconnection system as described in claim 7, wherein at least one of said modularized base sections has a first engaging surface and a second engaging surface oppositely formed thereon and respectively confronting with adjacent base sections for engaging therewith.

9. The high density interconnection system as described in claim 8, wherein said first engaging surface has at least one block formed thereon and said second engaging surface has at least one notch defined therein, said at least one block of the at least one of said modularized base sections being received in a notch of an adjacent modularized base section to securely connect the two modularized base sections together.

10. The high density interconnection system as described in claim 1, wherein said second fastening means comprises a first device and a second device, said first device being formed on one of said base sections and said second device being formed on a neighboring base section.

11. The high density interconnection system as described in claim 10, wherein said first device of said second fastening means defines a recess and a pair of opposed indents in a lower side thereof, and said second device of said second fastening means comprises a main body with a lock formed on an upper end thereof and a pair of embossments formed on opposite sides of a lower end of said main body, wherein said main body is received in said recess with said pair of embossments being retained in said pair of indents and said lock abutting against a top edge of said first device.

12. The high density interconnection system as described in claim 2, wherein each of said partition walls has a plurality of signal terminals arranged on one side thereof and a grounding member attached on an opposite side thereof.

13. The high density interconnection system as described in claim 7, wherein each of said inner walls has a plurality of signal contacts arranged on one side thereof and a grounding element attached on an opposite side thereof.

14. The high density interconnection system as described in claim 1, wherein said insulative base of said second electrical connector further has a pair of side walls formed on opposite sides thereof, each side wall defining thereon at least one groove, and said cover of said second electrical connector has at least one claw formed on each of opposite sides thereof, said claws being received in corresponding grooves and abutting thereagainst thereby to firmly fasten said cover with said base.

* * * * *